US005435508A

United States Patent [19]

Deuitch et al.

[11] Patent Number: 5,435,508

[45] Date of Patent: Jul. 25, 1995

[54] WRIST REST SUPPORT

[76] Inventors: Jeffery Deuitch; Lynn Deuitch, both of 824 35th Ave. Dr. W., Palmetto, Fla. 34221

[21] Appl. No.: 283,530

[22] Filed: Aug. 1, 1994

Related U.S. Application Data

[63] Continuation-in-part of Ser. No. 21,791, Feb. 24, 1993, abandoned.

[51] Int. Cl.[6] ..... B63G 5/00

[52] U.S. Cl. ..... 248/118; 400/715

[58] Field of Search ..... 248/118, 118.1, 118.3, 248/118.5, 918; 297/411, 416; 400/715

[56] References Cited

U.S. PATENT DOCUMENTS

| | | | |
|---|---|---|---|
| 4,220,309 | 9/1980 | Eisen | 248/542 |
| 4,688,862 | 8/1987 | Fowler | 248/118.5 X |
| 4,896,388 | 1/1990 | Bard | 5/644 |
| 5,050,826 | 9/1991 | Johnson | 400/715 X |
| 5,125,606 | 6/1992 | Cassano | 400/715 X |
| 5,148,256 | 10/1992 | Gross | 248/118.3 |
| 5,158,255 | 10/1992 | Fuller | 248/118 |
| 5,170,971 | 12/1992 | Schaeffer | 248/118.1 |
| 5,173,979 | 12/1992 | Nennhaus | 5/644 X |
| 5,219,136 | 6/1993 | Hassel | 248/918 X |
| 5,228,655 | 7/1993 | Garcia | 400/715 X |

*Primary Examiner*—J. Franklin Foss
*Attorney, Agent, or Firm*—Franklin J. Cona

[57] ABSTRACT

An apparatus for supporting the wrist of a keyboard operator during repetitive keyboard operations is disclosed. The apparatus comprises a bladder having an elongated length and an arcuate cross-section, and enclosed sealed ends. The bladder contains a viscous fluid for supporting the wrist of the keyboard operator when the operator is engaged in repetitive keyboard operations. An outer shell completely surrounds the bladder and contacts the wrist of the operator. The outer shell has an aperture adapted to receive the bladder and remove the bladder when it is desired to wash the outer shell. The outer shell is fabricated from a material that will withstand repeated machine washings and will maintain a fresh odor-free aroma and a pleasant-to-the-touch, itch-free feeling. The viscous fluid contains about between 0.5% to 5.5% hydroxy propyl methylcellulose with the balance being water. The viscous fluid supports the wrist of the operator and allows unimpeded flow of blood through the wrist of the keyboard operator. The bladder is fabricated from an elastomeric material, preferably frosted vinyl plastic. The ends of the bladder are sealed to hold the viscous fluid in the bladder without any possibility of leakage.

9 Claims, 3 Drawing Sheets

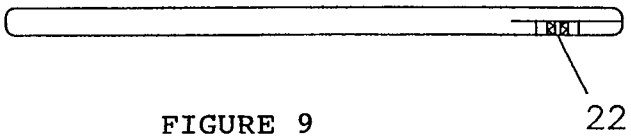
FIGURE 9
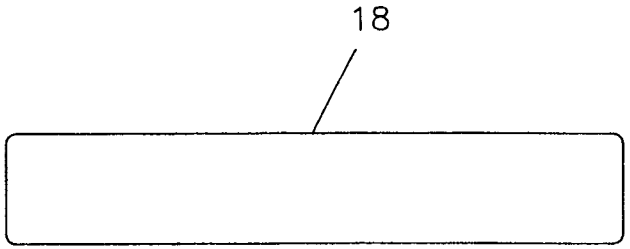
FIGURE 11
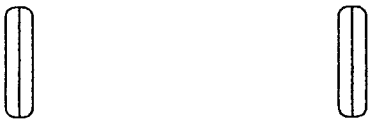
FIGURE 13
FIGURE 14
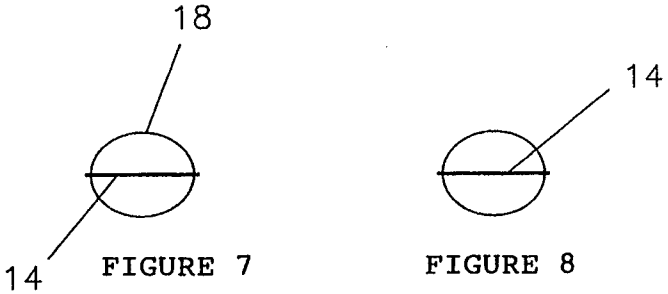
FIGURE 8
FIGURE 7
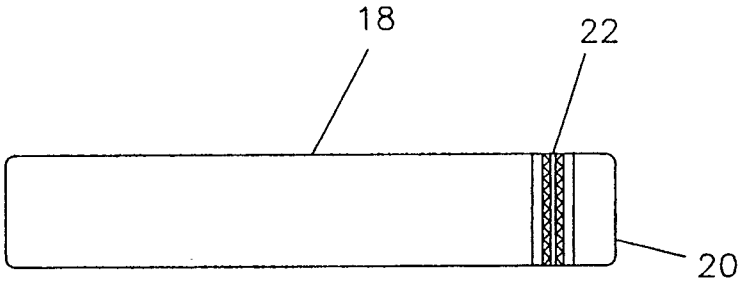
FIGURE 10
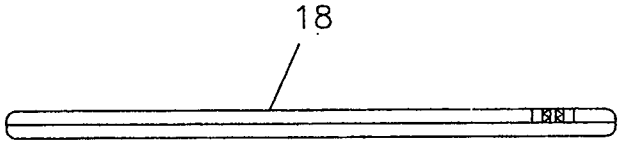
FIGURE 12

WRIST REST SUPPORT

This application is a continuation-in-part application of application Ser. No. 08/021,791, filed Feb. 24, 1993, now abandoned.

BACKGROUND OF THE INVENTION

1. Field of the Invention

This invention is related to a wrist support, and in particular a viscous, fluid filled wrist support for use during keyboard operations that require repetitive motion of the hands and wrist.

2. Description of the Background Art

Throughout the United States steps are being taken to improve wrist supports. The increased use of the computer keyboard for data entry throughout the United States has increased the requirement for comfort for those people engaged in repetitive keyboard operations. Many learned journals have cited the potential adverse health effects of "Carpal Tunnel Syndrome" (CTS) that heretofore was not a problem when data was entered manually on sheets of paper and adding machine tapes. The CTS syndrome is a relatively new phenomenon that has arisen as computers and keyboards have become the preferred method of entering data throughout the United States.

Symptoms of the problem include tendinitis, which is an inflammation and swelling of the tendons including the hands, wrists and arms, epicondylitis (tennis elbow) which is an irritation of the tendon connecting the forearm muscles to the elbow joints, and de Quervain's disease which is a form of tendinitis that affects the tendons that are connected to the thumb.

Many employers are taking steps to alleviate the CTS problem with wrist supports. For example, the Social Security Administration of the United States government provides wrist supports to those employees engaged in repetitive keyboard operations.

U.S. Pat. No. 5,125,606 issued to Cassano discloses a wrist support using a foam rubber pad that is stapled and glued to a wooden subbase.

U.S. Pat. No. 4,545,554 issued to Latino et al. discloses a solid hard surfaced support. Further, patent '554 discloses a height adjustment to allow the device to be adjusted to the preferred orientation of the operator to the keyboard.

U.S. Pat. No. 4,976,407 issued to Schwartz et al. discloses a solid, hard wrist support connected by a plurality of mounting brackets to a sub-base. Patent '407 discloses an apparatus to adjust the angle and elevation of the wrist support in relation to the keyboard and the operators desired orientation.

U.S. Pat. No. 4,913,390 issued to Burke discloses a keyboard support with a solid handrest.

U.S. Pat. No. 5,004,196 issued to Gross discloses the use of two pivoting pads independently mounted to support the wrist.

U.S. Pat. No. 5,040,757 issued to Benaway discloses a one-piece laddering device for adjusting the computer keyboard itself.

U.S. Pat. No. 5,072,905 issued to Hyatt discloses a cushioned support for the wrist having a pivotally connected supporting members for the forearm.

U.S. Pat. No. 5,108,057 issued to Dandy, et AL. discloses a wrist support having two independent wrist pads that slide laterally on a railing that is externally attached to a keyboard.

U.S. Pat. No. 5,088,668 issued to Grimm discloses a hard surfaced, solid pad mounted on a cylindrically shaped base to support the wrist of the operator.

None of these previous efforts, however, provide the benefits intended with the present invention. Additionally, prior techniques do not suggest, the present inventive combination of component elements as disclosed and claimed herein. The present invention achieves its intended purposes, objectives and advantages over the prior art devices through a new, useful and unobvious combination of component elements, which is simple to use, with the utilization of a minimum number of functioning parts, at a reasonable cost to manufacture, assemble, test and by employing only readily available material.

Therefore it is an object of the present invention to provide a wrist rest support that relieves carpal tunnel syndrome for people engaged in repetitive keyboard operations.

It is a further object of the invention to provide a wrist rest support that will accommodate to the various shapes and heights preferences of each individual keyboard operator.

It is a still further object of the invention to provide a wrist rest support that allows unimpeded blood flow through the arteries in the wrist, forearms and hands.

It is a still further object of the invention to provide a wrist rest support that functions equally well regardless of the objects of personal adornment that the operator might wear on the wrist, such as watches, jewelry, bracelets, or the like.

It is a still further object of the invention to provide a wrist rest support that can be maintained in an odor free, contaminant free condition.

A final object of this invention to be specifically enumerated herein is to provide a wrist rest in accordance with the proceeding objects and which will conform to conventional forms of manufacture, be of simple construction and easy to use so as to provide a device that would be economically feasible, long lasting and relatively trouble free in operation.

Although there have been many inventions related to a wrist rest none of the inventions have become sufficiently compact, low cost and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into an apparatus for supporting the wrists of the keyboard operator doing repetitive manual operations. The invention comprises a bladder that is elongated in length and has an arcuate cross section. The bladder contains a viscous fluid preferably hydroxy propyl methylcellulose in a range of 0.5% to 5.5% with the balance being water in a closed sealed reservoir therein. The hydroxy propyl methylcellulose compound provides the proper viscosity to support the wrist of the keyboard operator when engaged in repetitive keyboard operation and further, allows unimpeded blood flow through the arteries in the forearms, wrists, and hands. The apparatus has an outer shell that completely encloses the bladder and contacts the wrist of the operator when in use and operation. The outer shell has an aperture at one end adapted for receiving the fluid filled bladder. After a period of time when the outer shell has absorbed odors and other contaminants, the bladder is removed from the outer shell through the aperture, and the outer shell is machine washed. After the shell is dry, the bladder is reinserted through the aperture in the outer shell and the wrist rest is redeployed for use and operations. In this manner, the outer shell maintains a pleasant to-the-touch feeling and an odor free smell.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 6 depicts the fluid within the bladder as a plurality of dark dots.

FIG. 7 is a left hand end view of the fluid filled bladder.

FIG. 8 is a right hand end view of the fluid filled bladder.

FIG. 9 is a front elevational view of the outer shell showing the aperture in the rightmost portion of the shell. The aperture is adapted to receive the fluid filled bladder to comprise the invention after installation.

FIG. 10 is a top plan view of the outer shell.

FIG. 11 is a bottom plan view of the outer shell.

FIG. 12 is a rear elevational view of the shell.

FIG. 13 is a left hand view of the shell.

FIG. 14 is a right hand end view of the shell.

Similar reference characters refer to similar parts throughout the several views of the drawings.

DETAILED DESCRIPTION OF THE PREFERRED EMBODIMENT

Figure 1:
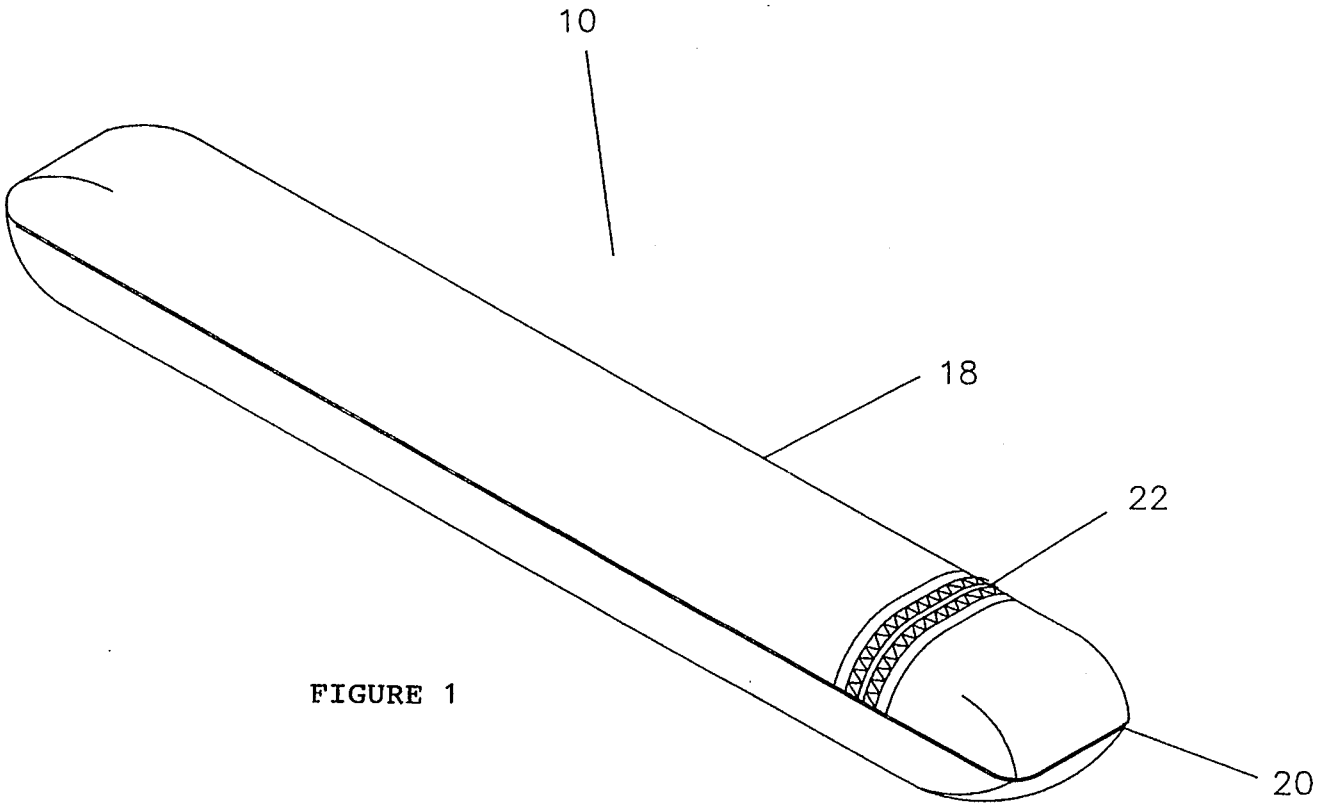
FIG. 1 is a perspective of the invention showing the outer sleeve or shell having a aperture to allow for insertion of a fluid filled bladder.
Figure 3:
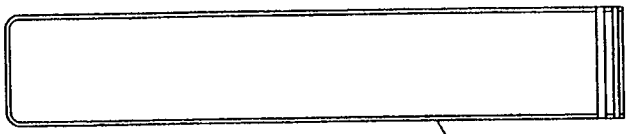
FIG. 3 is a top plan view of the bladder.
Figure 4:
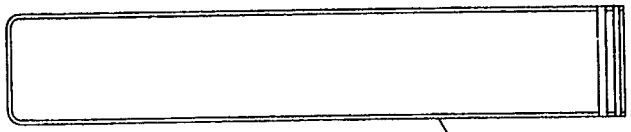
FIG. 4 is the bottom plan view of the bladder.
Figure 6:
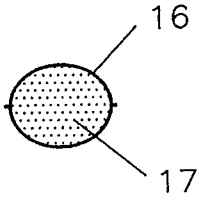
FIG. 6 is a cross sectional view of the fluid filled bladder taken along viewing lines 6—6 in FIG. 5.
Figure 2:
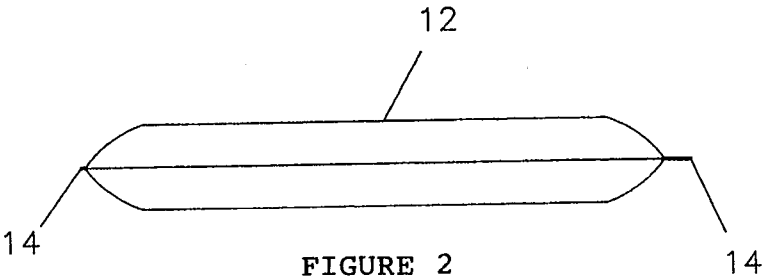
FIG. 2 is a front elevational view of the fluid filled bladder prior to insertion in the outer sleeve or shell.
Figure 5:
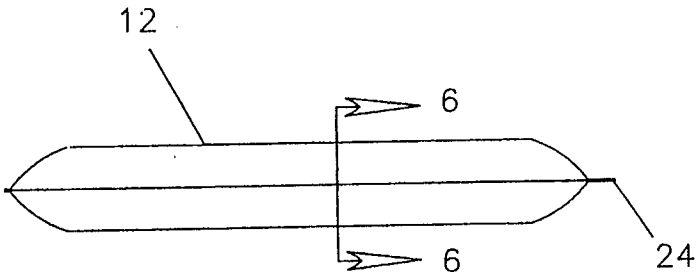
FIG. 5 is a rear elevational view of the bladder.

Referring to FIG. 1, the invention 10 comprises a bladder 12 having an elongated length and an arcuate cross section with closed sealed ends 14, 14'. The bladder 12 forms a reservoir 16 that contains a specially formulated viscous fluid 17 that is compounded to support the wrist of the keyboard operator when the operator is engaged in repetitive keyboard operations. As best seen in FIG. 1, an outer shell 18 completely surrounds the bladder 12 and provides comfortable itch-free contact with the wrist of the user when in use and operation. The outer shell 18 has an end 20 with an aperture 22 adapted to receive the bladder 12. When the outer shell 18 needs cleaning, the bladder 12 is removed through the aperture 22 and set aside for subsequent reinsertion into the outer shell 18 after the outer shell 18 has been washed to remove odors and any other materials that have built up on the outer shell 18 from repeated use by the keyboard operator.

The preferred embodiment for the viscous fluid 17 is hydroxy propyl methylcellulose. Other fluid compounds such as water can be used, but it was found that the hydroxy propyl methylcellulose in a composition of about between 0.5% to 5.5% with the balance being water provides the proper viscosity to minimize operator fatigue and provide comfort, while still allowing the blood to circulate freely through the arteries and veins in the wrist of the operator.

The bladder 12 is fabricated from an elastomeric material, preferably a frosted vinyl plastic. The bladder 12 will conform to the shape of the wrist, and in particular to the shape of the wrist including wrist watches, bracelets, etc. that operators wear to work as part of their normal dress. In other words, the bladder 12 will conform to the shape of the wrist and/or whatever jewelry the operator happens to have on at that particular time. In this manner, the operator is free to wear whatever jewelry or articles of adornment without fear of negative health consequences when engaging in repetitive keyboard operations.

The viscous fluid 17 is designed to provide a level of resiliency that will maintain unimpeded blood flow through the arteries and veins of the wrist of the operator without constricting the arteries and veins while the operator is engaged in repetitive keyboard operations.

The outer shell 18 of the invention is made from a machine washable material, preferably a cotton type material that can withstand repeated machine washings without any degradation of the pleasant to-the-touch feeling that natural fibers give. Alternatively, a synthetic fiber can be used for the outer shell 18, such as nylon or the like. If desired, the bladder 18 can be used without the outer shell for any reasons including allergies and other factors.

The bladder 12 is filled with the viscous fluid 17, preferably the hydroxy propyl methylcellulose through an end 24 that is adapted to be sealed after the bladder 12 is filled with the viscous fluid 17. Water can be used as the viscous fluid 17, although it is less preferred. After filling, the end 24 is sealed to prevent any leakage from the bladder 12. There is no further need for refills of any sort as the bladder 12 is now in a leak proof state, and the viscous fluid 17 is in a stabilized condition.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described,

What is claimed is:

1. An apparatus for supporting the wrists of a keyboard operator during repetitive keyboard operations comprising in combination:

a sealed bladder having an elongated length and an arcuate cross-section and closed, sealed ends for forming a flexible reservoir, the reservoir containing a viscous fluid for supporting the wrists of the key-board operator when engaged in repetitive keyboard operations; and an outer shell enclosing the bladder and having a smooth uniform outer surface for maintaining continuous contact with the wrists of the user, the outer shell further having an aperture adapted to receive the bladder in removable communication, the outer shell still further being fabricated from a washable material, preferably polyester velour for urging fresh odor-free contact with the wrists of the keyboard operator.

2. An apparatus for supporting the wrists of a keyboard operator as recited in claim 1 wherein the viscous fluid further includes hydroxy propyl methylcellulose in a range of about between 0.5% to 5.5% and the balance being water.

3. An apparatus for supporting the wrists of a keyboard operator as recited in claim 1 wherein the bladder conforms to the shape of the wrists regardless of the position of the wrists on the apparatus.

4. An apparatus for supporting the wrists of a keyboard operator as recited in claim 1 wherein the viscous fluid supports the wrists and does not constrict the arteries which could impede the flow of blood through the wrists of the keyboard operator.

5. An apparatus for supporting the wrists of a keyboard operator as in claim 1 wherein the bladder is fabricated from an elastomeric material.

6. An apparatus for supporting the wrists of a keyboard operator as in claim 5 wherein the elastomeric material is a frosted vinyl plastic.

7. An apparatus for supporting the wrists of a keyboard operator as in claim 1 wherein the ends are attached to the elongated member in sealing communication for holding the viscous fluid in the bladder and preventing leakage of the viscous fluid from the bladder.

8. An apparatus for supporting the wrists of a keyboard operator as in claim 1 wherein the outer shell is fabricated from a material that can be repeatedly machine washed for maintaining a pleasant to the touch feeling and an odor-free aroma.

9. An apparatus for supporting the wrists of a keyboard operator as in claim 1 wherein the viscous fluid is water.

* * * * *